US008895881B2

(12) United States Patent
Nose et al.

(10) Patent No.: US 8,895,881 B2
(45) Date of Patent: Nov. 25, 2014

(54) POWER WINDOW SWITCH

(75) Inventors: Takashi Nose, Kasugai (JP); Manabu Sakai, Kasugai (JP); Yasuhide Tanaka, Kasugai (JP); Hidetoshi Yoshikawa, Kasugai (JP); Akira Goto, Kasugai (JP); Shiho Nakano, Kuwana (JP); Takuya Nishioka, Kasugai (JP); Tomohiro Takahashi, Kasugai (JP); Yoshifumi Ohwa, Kasugai (JP); Keiichi Shimizu, Kasugai (JP); Daisuke Kitagawa, Iida (JP); Kosuke Hirano, Iida (JP); Masahiko Hara, Iida (JP); Hiroaki Ohta, Iida (JP)

(73) Assignee: Omron Automotive Electronics Co., Ltd., Aichi (JP)

( * ) Notice: Subject to any disclaimer, the term of this patent is extended or adjusted under 35 U.S.C. 154(b) by 141 days.

(21) Appl. No.: 13/529,272

(22) Filed: Jun. 21, 2012

(65) Prior Publication Data

US 2012/0325636 A1 Dec. 27, 2012

(30) Foreign Application Priority Data

Jun. 21, 2011 (JP) ..... 2011-137414

(51) Int. Cl.
*H01H 1/26* (2006.01)
*H01H 13/56* (2006.01)

(52) U.S. Cl.
CPC ..... *H01H 13/56* (2013.01); *H01H 2239/014* (2013.01); *H01H 2235/028* (2013.01); *H01H 2300/01* (2013.01)
USPC ..... 200/535

(58) Field of Classification Search
CPC . H01H 13/14; H01H 23/00; H01H 2085/208; H01H 1/5805; H01H 1/5822; H01H 9/02; H01H 23/003; H01H 23/02; H01H 3/00; H01H 3/02; G05G 1/04; B60R 16/005; B60R 21/09
USPC ..... 200/330, 329, 535, 532
See application file for complete search history.

(56) References Cited

U.S. PATENT DOCUMENTS

| | | | | |
|---|---|---|---|---|
| 5,350,889 | A * | 9/1994 | Lauritsen | 200/1 B |
| 5,647,478 | A | 7/1997 | Hirai | |
| 6,576,853 | B2 | 6/2003 | Motojima | |
| 7,098,415 | B2 | 8/2006 | Onodera | |
| 2002/0079202 | A1 | 6/2002 | Motojima | |
| 2005/0092591 | A1 | 5/2005 | Onodera | |

FOREIGN PATENT DOCUMENTS

| | | | |
|---|---|---|---|
| JP | 3259883 | B2 | 2/2002 |
| JP | 2002175735 | A | 6/2002 |
| JP | 3670120 | B2 | 7/2005 |
| JP | 4047034 | B2 | 2/2008 |
| JP | 4429137 | B2 | 3/2010 |

* cited by examiner

*Primary Examiner* — Vanessa Girardi
(74) *Attorney, Agent, or Firm* — Osha Liang LLP

(57) ABSTRACT

A power window switch has a case, a substrate disposed in the case, a window operation knob disposed on the case, a window lock button disposed on a front side of the window operation knob on the case, a window operation switch mechanism disposed in the case and activated in accordance with an operation of the window operation knob, a window lock switch mechanism disposed in the case and activated in accordance with an operation of the window lock button, and a connector having a terminal with a first terminal end protruding from the case and a second terminal end connected to the substrate. The window lock switch mechanism includes two conductive plate springs, and a pressing unit for pressing the plate springs.

4 Claims, 7 Drawing Sheets

POWER WINDOW SWITCH

BACKGROUND OF THE INVENTION

1. Technical Field

The present invention relates to a power window switch, particularly to a switch mechanism for a window lock.

2. Related Art

A structure of a power window switch for a vehicle is disclosed in Japanese Patent Nos. 3259883, 4429137, 4047034, and 3670120, for example. A window operation knob, a window lock button, and the like are provided on a case of the power window switch. The window operation knob is operated for opening or closing a window glass of the vehicle. The window lock button is operated for locking the window glass so as not to open or close the window glass.

In the case, a substrate, a window operation switch mechanism, a window lock switch mechanism, and the like are provided. The window operation switch mechanism is activated in accordance with an operation of the window operation knob. The window lock switch mechanism is activated in accordance with an operation of the window lock button.

In a lower part or a rear part of the case, a connector for supplying electric power and sending and receiving signals is provided. A terminal of the connector has one end protruding from the case and the other end connected to the substrate. A cable for connecting to a control device and the like provided in the vehicle is inserted into the connector.

An operator, a small switch in which a contact is built, and the like are respectively provided in the window operation switch mechanism and the window lock switch mechanism. A slide switch, a direct-cutoff switch, a micro switch, or the like is used as the small switch. Instead of the small switch, a conductive body having a contact is sometimes provided. The small switch or the conductive body is connected to the substrate. The operator opens or closes the contact of the small switch or the contact of the conductive body in conjunction with the operation of the window operation knob or the window lock button. Japanese Unexamined Patent Publication No. 2002-175735 describes a switch mechanism in which contacts are provided in two conductive plate springs.

In order to prevent that a hand is abutted with the window lock button and the button is erroneously operated at the time of operating the window operation knob, the window lock button is provided on the front side of the window operation knob. Accordingly, the window lock switch mechanism is also provided on the front side of the window operation switch mechanism.

However, in a case where the window lock button and the window lock switch mechanism are provided on the front side, wide wiring has to be extensively pulled and formed over the substrate in order to supply the electric power from the connector to the contact of the window lock switch mechanism. Therefore, a freedom degree in design of the substrate is lowered, so that other parts, wiring, circuits, and the like are not easily installed and holes are not easily formed on the substrate.

SUMMARY

One or more embodiments of the present invention increases a freedom degree in design of a substrate in a power window switch in which a window lock button is provided on the front side of a window operation knob.

In accordance with one aspect of the present invention, a power window switch, includes a case, a substrate accommodated in the case, a window operation knob provided on the case, a window lock button provided on the front side of the window operation knob on the case, a window operation switch mechanism provided in the case and activated in accordance with an operation of the window operation knob, a window lock switch mechanism provided in the case and activated in accordance with an operation of the window lock button, and a connector having a terminal with one end protruding from the case and the other end connected to the substrate, wherein the window lock switch mechanism includes two conductive plate springs, and a pressing unit for pressing the plate springs. Each of the plate springs has one end in which a contact is provided, and the other end connected to the substrate in the vicinity of the other end of the terminal of the connector. By operating the window lock button, the pressing unit presses the plate springs or cancels the pressing, so that the contacts are connected or separated.

With the above configuration, when short wiring is formed from a connection part of the terminal of the connector to a connection part of the plate springs of the window lock switch mechanism in the vicinity of the above connection part on the substrate, electric power can be supplied to the contacts of the plate springs from the connector. Therefore, there is no need for extensively pulling and forming wide wiring over the substrate, so that the freedom degree in the design of the substrate can be increased in the power window switch in which the window lock button is provided on the front side of the window operation knob. By the operation of the window lock button, the contacts of the two plate springs of the window lock switch mechanism can be opened or closed.

In one or more embodiments of the present invention, in the above power window switch, the plurality of window operation switch mechanisms may be provided so as to be spaced from each other in the front and rear direction, and the other end of the terminal of the connector and the other ends of the plate springs may be connected to the substrate between the front and rear window operation switch mechanisms.

Further, in one or more embodiments of the present invention, in the above power window switch, the plate springs may be arranged on the opposite side to the side where the window operation knob and the window lock button are placed on the substrate.

According to one or more embodiments of the present invention, in the power window switch in which the window lock button is provided on the front side of the window operation knob, the freedom degree in the design of the substrate can be increased.

DETAILED DESCRIPTION

Figure 1:
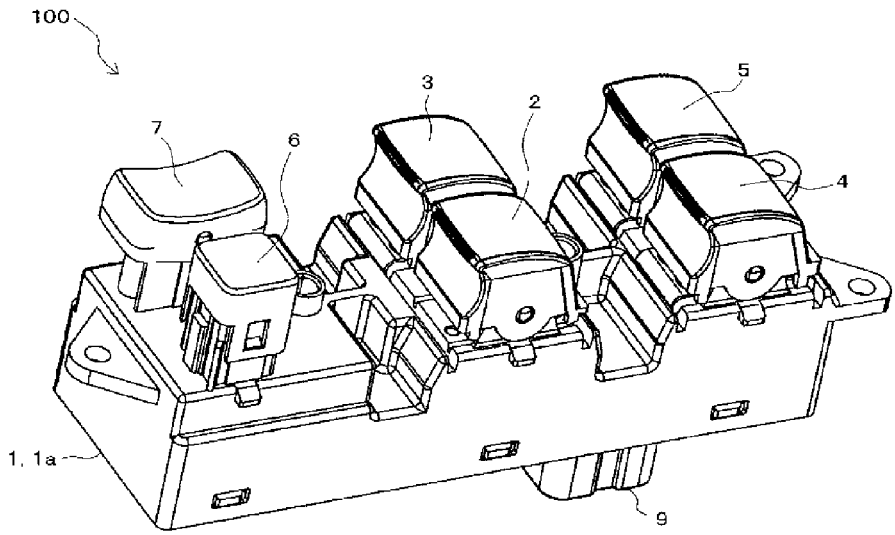
FIG. 1 is a perspective view of a power window switch according to one embodiment of the present invention.

Hereinafter, embodiments of the present invention will be described with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. In the figures, the same parts or corresponding parts will be given the same reference characters.

Figure 2:
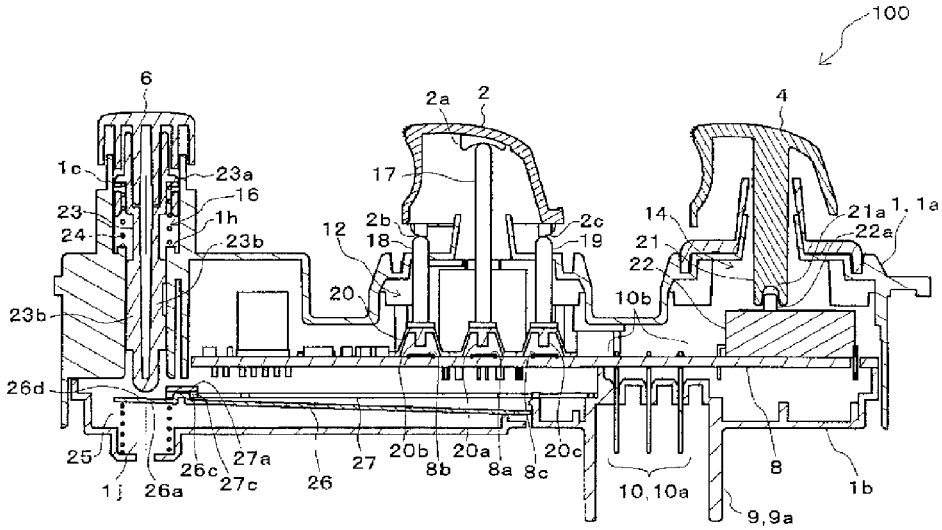
FIG. 2 is a sectional view of the power window switch of FIG. 1.

A power window switch 100 shown in FIG. 1 is attached to an armrest installed in a door of a driver seat of a vehicle. A case 1 of the power window switch 100 is assembled by fitting an upper member 1*a* and a lower member 1*b* to each other as shown in FIG. 2. It should be noted that in FIG. 2, the left direction is the front side, and the right direction is the rear side.

On the case 1, as shown in FIG. 1, window operation knobs 2 to 5, a window lock button 6, and a door lock button 7 are provided. The plurality of window operation knobs 2 to 5 is provided so as to be spaced from each other in the front and rear direction. That is, one pair of adjacent window operation knobs 2, 3 is arranged on the front side, and another pair of adjacent window operation knobs 4, 5 is arranged on the rear side while being spaced from the window operation knobs 2, 3. The window lock button 6 and the door lock button 7 are arranged on the front side of the window operation knobs 2 to 5 on the case 1. These knobs 2 to 5 and the buttons 6, 7 are operated from the rear side of the power window switch 100. Thus, when the buttons 6, 7 are arranged on the rear side of the knobs 2 to 5, there is a fear that a hand is abutted with the buttons 6, 7 and the buttons 6, 7 are erroneously operated at the time of operating the window operation knobs 2 to 5. Therefore, by arranging the buttons 6, 7 on the front side of the knobs 2 to 5, such an erroneous operation is prevented.

The window operation knob 2 is oscillated and operated for opening or closing a window glass of the driver seat. The window operation knob 3 is oscillated and operated for opening or closing a window glass of a front passenger seat. The window operation knobs 4, 5 are oscillated and operated for opening or closing left and right window glasses of a rear seat.

The window lock button 6 is pushed down and operated for locking the window glasses of the seats so as not to open or close the window glasses, or cancelling the lock. The door lock button 7 is oscillated and operated for locking doors of the seats so as not to open the doors, or cancelling the lock.

Figure 3:
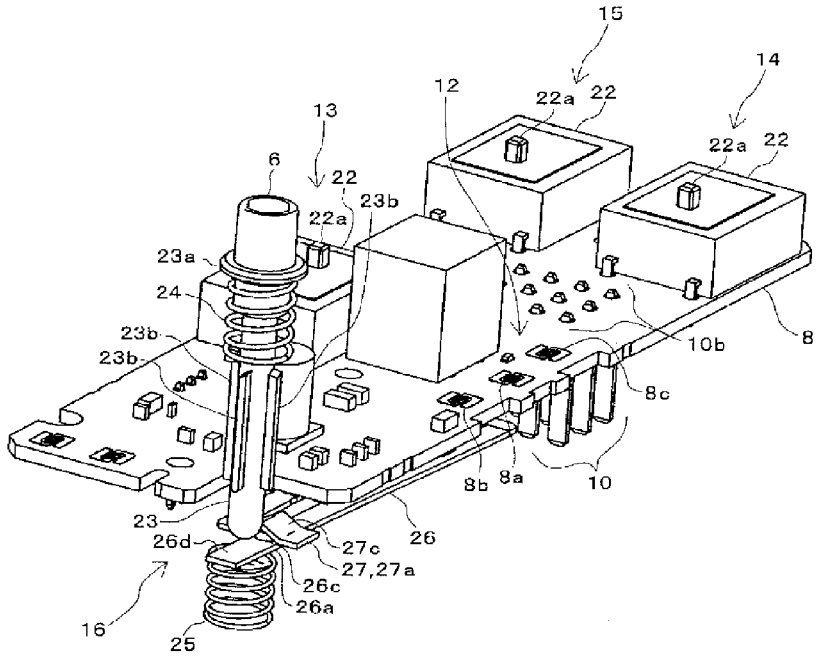
FIG. 3 is a perspective view of a state that a case of the power window switch of FIG. 1 is removed, the view being seen from the upper side.

As shown in FIGS. 2 and 3, in the case 1, a substrate 8, window operation switch mechanisms 12 to 15 provided correspondingly to the window operation knobs 2 to 5, a window lock switch mechanism 16 provided correspondingly to the window lock button 6, and the like are provided.

The window operation switch mechanisms 12 to 15 are arranged immediately below the window operation knobs 2 to 5. That is, the window operation switch mechanisms 12, 13 are arranged on the front side, and the window operation switch mechanisms 14, 15 are arranged on the rear side while being spaced from the window operation switch mechanisms 12, 13 (refer to FIG. 3). The window operation switch mechanisms 12 to 15 are activated in accordance with an operation of the window operation knobs 2 to 5.

Most parts of the window lock switch mechanism 16 are arranged immediately below the window lock button 6 on the front side of the window operation switch mechanisms 12 to 15 on the substrate 8. The window lock switch mechanism 16 is activated in accordance with an operation of the window lock button 6.

In addition, in the case 1, a door lock switch mechanism provided correspondingly to the door lock button 7 is provided (not shown). The door lock switch mechanism is arranged immediately below the door lock button 7 on the front side of the window operation switch mechanisms 12 to 15 on the substrate 8. The door lock switch mechanism is activated in accordance with an operation of the door lock button 7.

The substrate 8 is nipped and supported by the upper member 1*a* and the lower member 1*b* of the case 1 from the upper and lower sides. Electronic parts, wiring, and circuits are installed on the substrate 8.

Figure 4:
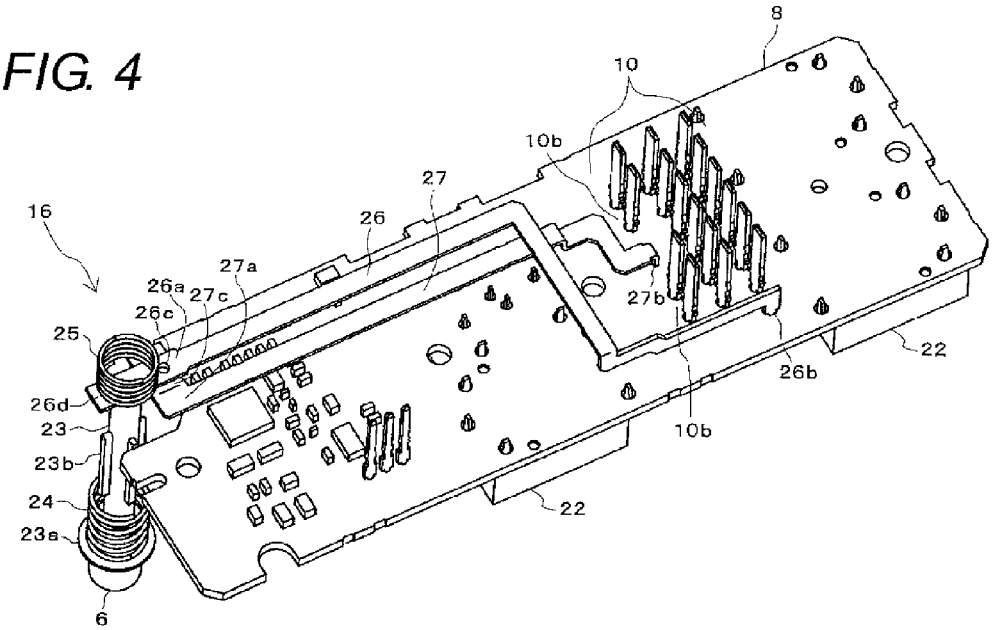
FIG. 4 is a perspective view of the state that the case of the power window switch of FIG. 1 is removed, the view being seen from the lower side.

A connector 9 provided with terminals 10 is provided in a lower part of the case 1. A housing 9*a* of the connector 9 is integrated with the lower member 1*b* of the case 1. One ends 10*a* of the terminals 10 of the connector 9 protrude from the lower member 1*b*, and the other ends 10*b* are connected to the substrate 8. In detail, as shown in FIGS. 2 to 4, there is some space between the front window operation switch mechanisms 12, 13 and the rear window operation switch mechanisms 14, 15 on the substrate 8. In this space, that is, between the front and rear window operation switch mechanisms, the other ends 10*b* of the terminals 10 of the connector 9 are connected to the substrate 8.

A cable for connecting to a control device and the like provided in the vehicle is inserted into the connector 9 (not shown). By inserting the cable into the connector 9, electric power can be supplied to the power window switch 100 and signals can be sent and received between the power window switch 100 and the control device and the like.

As shown in FIG. 2, the window operation switch mechanism 12 is provided with operators 17 to 19, and a rubber member 20. The rubber member 20 has conductivity and is attached to the substrate 8. Movable contacts 20*a*, 20*b*, 20*c* are provided in the rubber member 20. The operators 17 to 19 are attached onto the rubber member 20 immediately above the movable contacts 20*a*, 20*b*, 20*c*. Upper ends of the operators 17 to 19 are engaged with convex portions 2*a*, 2*b*, 2*c* provided in the window operation knob 2.

As shown in FIG. 3, fixed contacts 8*a*, 8*b*, 8*c* are provided on the substrate 8 immediately below the movable contacts 20*a*, 20*b*, 20*c*. Since distances between the fixed contacts 8*a*, 8*b*, 8*c* and the terminals 10 of the connector 9 are close, short wiring for supplying the electric power from the terminals 10 to the fixed contacts 8*a*, 8*b*, 8*c* is formed on the substrate 8 (not shown).

From an initial state shown in FIG. 2, by oscillating and operating the window operation knob 2, the operators 17 to 19 are pushed down by the convex portions 2*a* to 2*c* of the window operation knob 2 or pushed up by the rubber member 20, so that the movable contacts 20*a*, 20*b*, 20*c* and the fixed contacts 8*a*, 8*b*, 8*c* are connected or separated. By outputting such an open/close state of the movable contacts 20*a*, 20*b*, 20*c* and the fixed contacts 8*a*, 8*b*, 8*c* to the control device via the substrate 8, the connector 9, and the cable, the window glass of the driver seat is opened or closed.

Each of the window operation switch mechanisms 13 to 15 is provided with an operator 21 and a slide switch 22 (FIG. 2 only shows the window operation switch mechanism 14). The operator 21 is respectively integrated with the window operation knobs 3 to 5. An operation portion 22*a* is provided in an upper part of the slide switch 22. The operation portion 22*a* is engaged with a concave portion 21*a* provided in a lower end of the operator 21. A contact, a spring, and the like are provided inside the slide switch 22 (not shown).

As shown in FIG. 3, the slide switches 22 are connected to the substrate 8. Since distances between the slide switches 22 and the terminals 10 of the connector 9 are close, short wiring for supplying the electric power from the terminals 10 to the contacts inside the slide switches 22 is formed on the substrate 8 (not shown).

From the initial state shown in FIG. 2, by oscillating and operating the window operation knobs 3 to 5, the operators 21 make the operation portions 22*a* slide in the front and rear direction, so as to open or close the contacts inside the slide switches 22. By outputting open/close states of the contacts inside the slide switches 22 to the control device via the substrate 8, the connector 9, and the cable, the window glasses of the front passenger seat and the rear seat are respectively opened or closed.

The window lock switch mechanism 16 is provided with an operator 23, two coil springs 24, 25, and two plate springs 26, 27. The operator 23 is inserted into a tube portion 1*c* provided in the upper member 1*a* of the case 1. The window lock button 6 is attached to an upper end of the operator 23. The coil spring 24 is provided between a flange portion 23*a* of the operator 23 and a level difference portion 1*h* in the tube portion 1*c*. The coil spring 24 presses the flange portion 23*a* of the operator 23 upward.

Four rib portions 23*b* are provided at equal intervals on an outer circumferential surface of the operator 23 on the lower side of the coil spring 24 (refer to FIG. 3). The rib portions 23*b* extend in the axial direction of the operator 23. On an inner circumferential surface of the tube portion 1*c*, four lock projections 1*d* as shown in FIGS. 6A to 6D (development views of the inner circumferential surface) are provided at equal intervals. The operator 23, the rib portions 23*b*, the tube portion 1*c*, the coil spring 24, and the lock projections 1*d* form a so-called push-lock mechanism.

FIGS. 6A to 6D are enlarged views of major parts of the push-lock mechanism. In detail, FIGS. 6A to 6D are development views of the rib portions 23*b* of the operator 23 and the lock projections 1*d* of the tube portion 1*c*. An inclined surface 23*c* is formed in an upper end of each of the rib portions 23*b*. Two inclined surfaces 1*e*, 1*f* and a level difference portion 1*g* are formed in each of the lock projections 1*d*. On the inclined surfaces 23*c* of the rib portions 23*b*, the inclined surfaces 1*e*, if of the lock projections 1*d* slide. The rib portions 23*b* are engaged with the level difference portions 1*g* of the lock projections 1*d*.

As shown in FIGS. 2 to 5A and 5B, the coil spring 25 and the plate springs 26, 27 are arranged on the back side of the substrate 8 which is opposite to the surface side where the window operation knobs 2 to 5 and the window lock button 6 are placed. The plate springs 26, 27 are formed by bending conductive metal (such as copper).

Figure 7A:
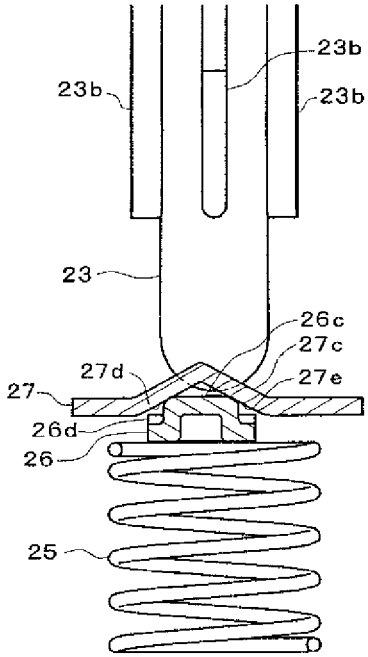
FIGS. 7A and 7B are enlarged views of major parts of a window lock switch mechanism provided in the power window switch of FIG. 1.
Figure 7B:
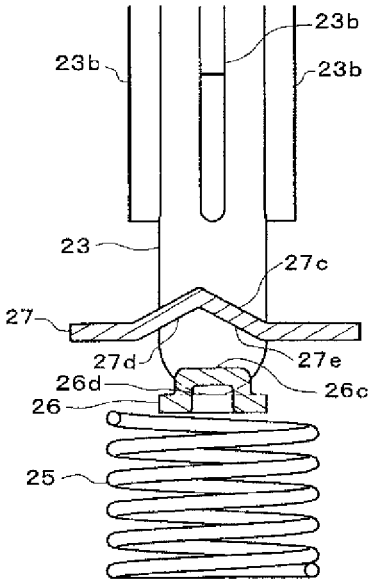

FIGS. 7A and 7B are enlarged views of major parts of the window lock switch mechanism 16. In detail, FIGS. 7A and 7B are enlarged views of the vicinity of contacts 26*c*, 27*c* of the plate springs 26, 27. The contact 26*c* of the plate spring 26 is formed into a convex shape. The contact 27*c* of the plate spring 27 is formed into a concave shape having two inclined surfaces 27*d*, 27*e*. A vicinity part of the contact 27*c* of the plate spring 27 is fixed to the lower member 1*b* of the case 1.

Figure 5A:
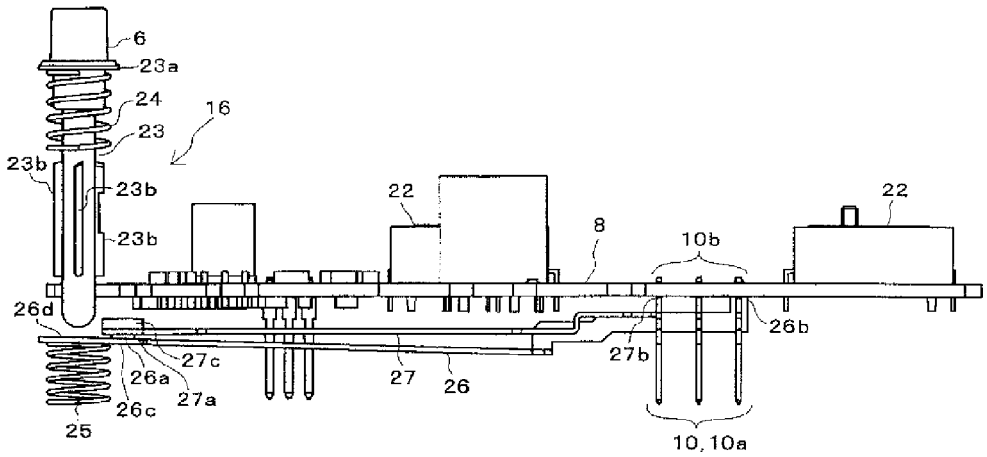
FIGS. 5A and 5B are side views of the state that the case of the power window switch of FIG. 1 is removed.
Figure 5B:
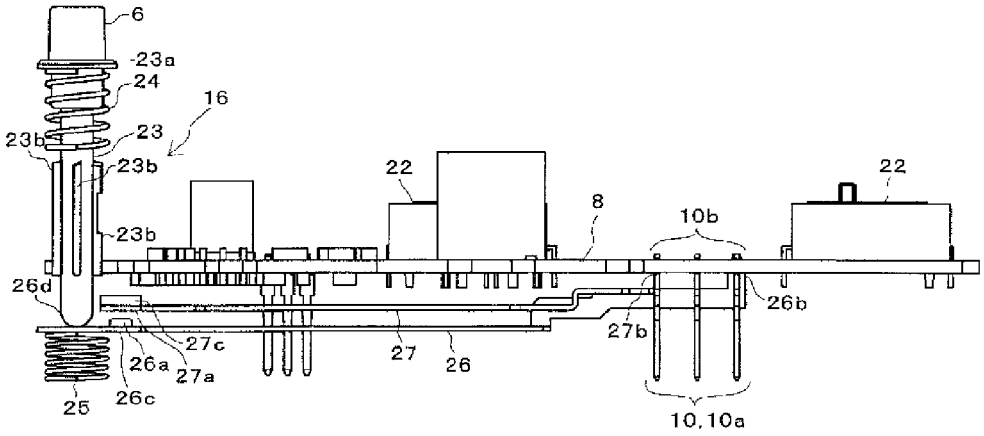

As shown in FIGS. 2, 5A, and 5B, a pressed portion 26*d* is provided in one end 26*a* of the plate spring 26. The operator 23 presses the pressed portion 26*d* of the plate spring 26 downward. As shown in FIG. 2, the coil spring 25 is fitted into a concave portion 1*j* formed in the lower member 1*b* of the case 1. The coil spring 25 presses the pressed portion 26*d* of the plate spring 26 upward. The operator 23 and the coil spring 25 are one example of a "pressing unit" according to one or more embodiments of the present invention.

As shown in FIG. 4, the other ends 26*b*, 27*b* of the plate springs 26, 27 are connected to the substrate 8 in the vicinity of the other ends 10*b* of the terminals 10 of the connector 9. That is, as shown in FIGS. 2 to 4, between the front window operation switch mechanisms 12, 13 and the rear window operation switch mechanisms 14, 15 where there is some space on the substrate 8, the other ends 26*b*, 27*b* of the plate springs 26, 27 are connected to the substrate 8.

Since distances between the other ends 26*b*, 27*b* of the plate springs 26, 27 and the terminals 10 of the connector 9 are close, short wiring for supplying the electric power from the terminals 10 to the contacts 26*c*, 27*c* of the plate springs 26, 27 is formed on the substrate 8 (not shown).

Figure 6A:
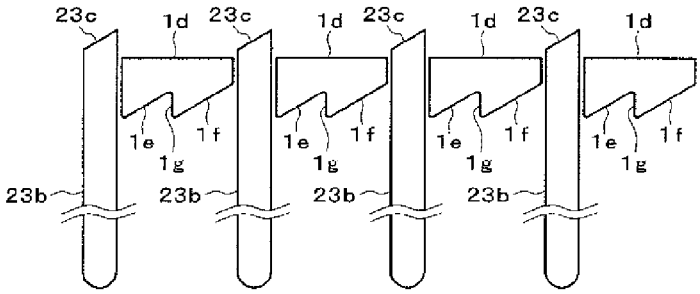
FIGS. 6A to 6D are enlarged views of major parts of a push-lock mechanism provided in the power window switch of FIG. 1.

In the initial state shown in FIGS. 2 and 5A, the rib portions 23*b* of the operator 23 are detached from the lock projections 1*d* of the tube portion 1*c* as shown in FIG. 6A. Therefore, the operator 23 and the window lock button 6 are pushed up by the coil spring 24, and a lower end of the operator 23 is placed away from the pressed portion 26*d* of the plate spring 26.

The coil spring 25 presses the pressed portion 26*d* of the plate spring 26 upward, and the contact 26*c* of the plate spring 26 is brought into contact with the inclined surfaces 27*d*, 27*e* of the contact 27*c* of the plate spring 27 as shown in FIG. 7A. That is, the contacts 26*c*, 27*c* of the plate springs 26, 27 are in a closed state.

Figure 6B:
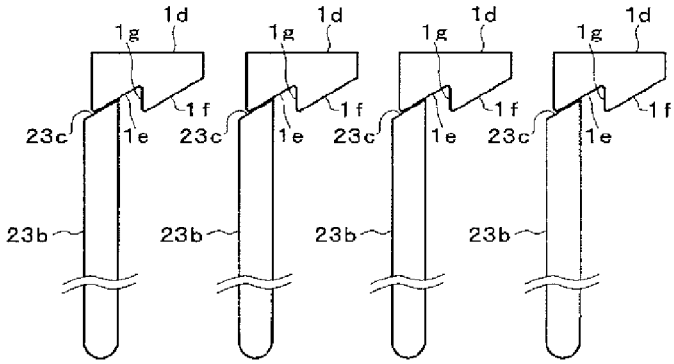
Figure 6C:
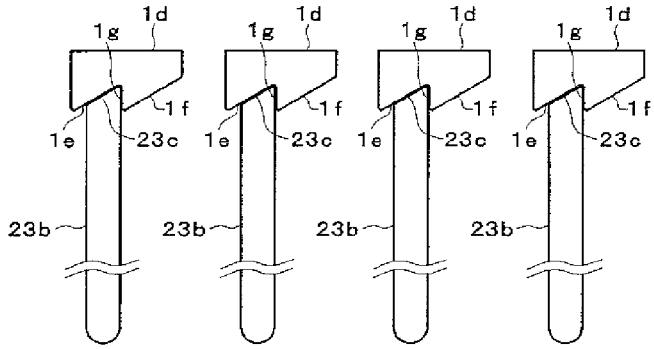

When the window lock button 6 is pushed down and operated from such an initial state, the operator 23 is lowered, and the inclined surfaces 23*c* of the rib portions 23*b* slide on the first inclined surfaces 1*e* of the lock projections 1*d* as shown in FIG. 6B. The rib portions 23*b* are engaged with the level difference portions 1*g* of the lock projections 1*d* as shown in FIG. 6C, and the operator 23 and the window lock button 6 are locked at a lowered position as shown in FIG. 5B.

Therefore, the operator 23 presses the pressed portion 26*d* of the plate spring 26 downward, and the contact 26*c* of the plate spring 26 is placed away from the inclined surfaces 27*d*, 27*e* of the contact 27*c* of the plate spring 27 as shown in FIG. 7B. That is, the contacts 26*c*, 27*c* of the plate springs 26, 27 are in an opened state.

Figure 6D:
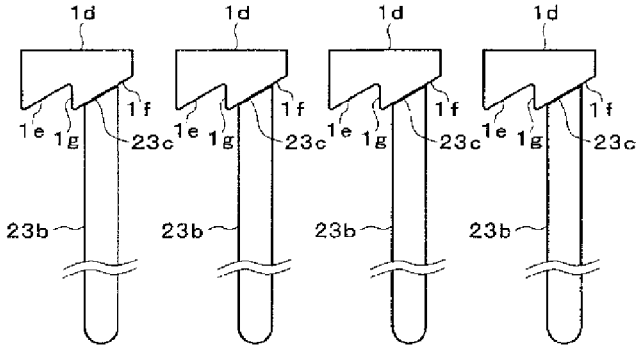

After that, when the window lock button 6 is pushed down and operated again, the operator 23 is lowered, and the inclined surfaces 23*c* of the rib portions 23*b* go beyond the level difference portions 1*g* of the lock projections 1*d* and slide on the second inclined surfaces if as shown in FIG. 6D. When the rib portions 23*b* are detached from the lock projections 1*d*, the operator 23 and the window lock button 6 are pushed up by the coil spring 24, so as to return to the initial state shown in FIGS. 2 and 5A. That is, the lower end of the operator 23 is placed away from the pressed portion 26*d* of the plate spring 26, and pressing of the pressed portion 26*d* by the operator 23 is cancelled.

Therefore, the coil spring 25 presses the pressed portion 26*d* of the plate spring 26 upward, and the contact 26*c* of the plate spring 26 is brought into contact with the inclined surfaces 27*d*, 27*e* of the contact 27*c* of the plate spring 27 as shown in FIG. 7A. That is, the contacts 26*c*, 27*c* of the plate springs 26, 27 are in the closed state.

In one or more embodiments of the present invention, as described above, when the short wiring is formed from a connection part of the terminals 10 of the connector 9 to a connection part of the other ends 26*b*, 27*b* of the plate springs 26, 27 of the window lock switch mechanism 16 in the vicinity of the above connection part on the substrate 8, the electric power can be supplied to the contacts 26*c*, 27*c* of the plate springs 26, 27 from the connector 9. Therefore, there is no need for extensively pulling and forming wide wiring over the substrate 8, so that a freedom degree in design of the substrate 8 can be increased.

In one or more embodiments of the present invention, since the window lock button 6 is provided on the front side of the window operation knobs 2 to 5, the erroneous operation of the window lock button 6 can be prevented at the time of operating the window operation knobs 2 to 5.

In one or more embodiments of the present invention, by pushing down and operating the window lock button 6, the operator 23 and the coil spring 25 press the pressed portion 26*d* of the plate spring 26 or the operator 23 cancels the pressing of the pressed portion 26*d*, so that the contacts 26*c*, 27*c* of the plate springs 26, 27 of the window lock switch mechanism 16 can be opened or closed.

In one or more embodiments of the present invention, the other ends 10*b* of the terminals 10 of the connector 9 and the other ends 26*b*, 27*b* of the plate springs 26, 27 are connected to the substrate 8 between the front window operation switch mechanisms 12, 13 and the rear window operation switch mechanisms 14, 15 where there is some space on the substrate 8. Thus, the freedom degree in the design of the substrate 8 can be more increased.

Further, in one or more embodiments of the present invention, since the plate springs 26, 27 are arranged on the back side of the substrate 8 where the window operation knobs 2 to 5 and the window lock button 6 are not placed, there is some space on the surface side of the substrate 8, so that the freedom degree in the design of the substrate 8 can be more increased.

Figure 8:
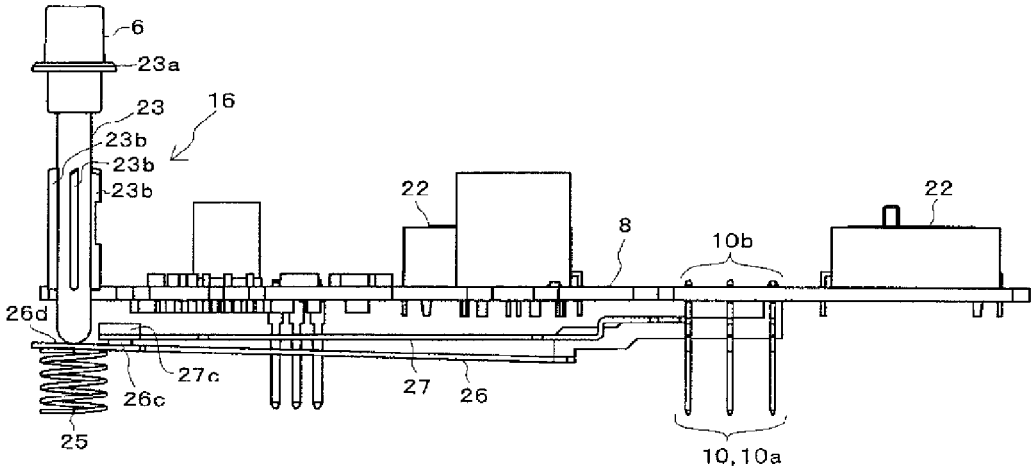
FIG. 8 is a side view of a state that the case of the power window switch is removed according to another embodiment.

Various embodiments other than the above embodiments can be adopted. For example, the above embodiments show the example that the operator 23 is pushed up by elastic force of the coil spring 24, so as to return to the initial state. However, the present invention is not limited to this. Apart from this, for example, the coil spring 24 may be omitted, and the operator 23 may be pushed up by elastic force of the coil spring 25 and the plate spring 26, so as to return to the initial state as shown in FIG. 8.

Figure 9:
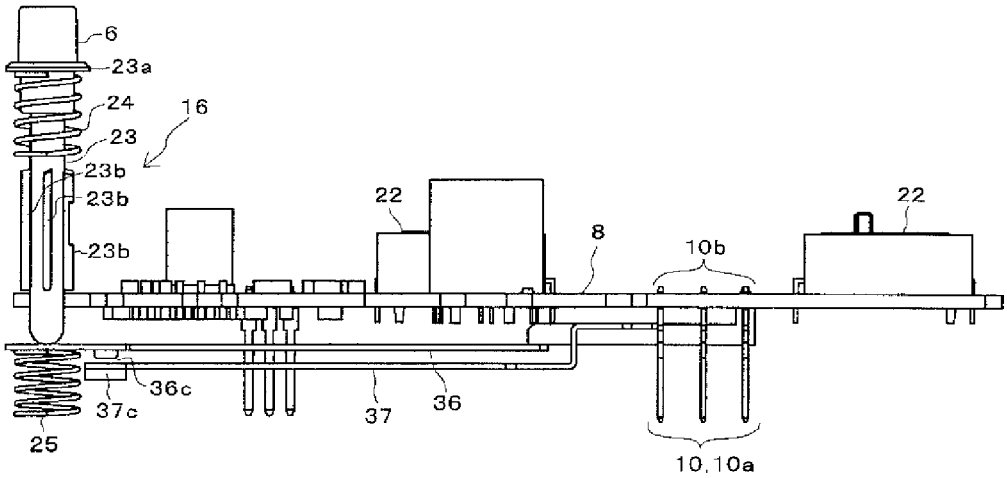
FIG. 9 is a side view of a state that the case of the power window switch is removed according to still another embodiment.
Figure 10:
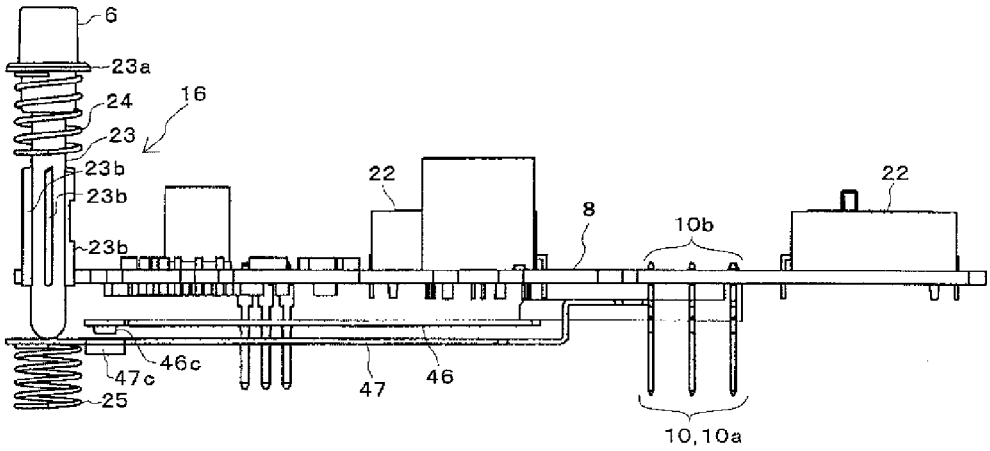
FIG. 10 is a side view of a state that the case of the power window switch is removed according to yet another embodiment.

The above embodiments also show the example that the concave contact 27*c* of the plate spring 27 is arranged on the upper side of the convex contact 26*c* of the plate spring 26, so that the contacts 26*c*, 27*c* are connected or separated as shown in FIGS. 5A, 5B, and the like. However, the present invention is not limited to this. Apart from this, for example, as shown in FIG. 9, a concave contact 37*c* of a plate spring 37 may be arranged on the lower side of a convex contact 36*c* of a plate spring 36, and the operator 23 may press the plate spring 36 downward or cancel the pressing, so that the contacts 36*c*, 37*c* can be connected or separated. As shown in FIG. 10, a concave contact 47*c* of a plate spring 47 may be arranged on the lower side of a convex contact 46*c* of a plate spring 46, and the operator 23 or the coil spring 25 may press the plate spring 47, so that the contacts 46*c*, 47*c* can be connected or separated.

Further, the above embodiments show the example that the plate springs 26, 27 are arranged on the back side of the substrate 8. However, the present invention is not limited to this. Apart from this, for example, in a case where the contacts and the switches provided in the window operation switch mechanism are provided on the back side of the substrate, or the like, the two plate springs of the window lock switch mechanism may be arranged on the surface side of the substrate where the window operation knobs and the window lock button are placed.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A power window switch, comprising:

a case;

a substrate disposed in the case;

a window operation knob disposed on the case;

a window lock button disposed on a front side of the window operation knob on the case;

a window operation switch mechanism disposed in the case and activated in accordance with an operation of the window operation knob;

a window lock switch mechanism disposed in the case and activated in accordance with an operation of the window lock button; and a connector having a terminal with a first terminal end protruding from the case and a second terminal end connected to the substrate, wherein the window lock switch mechanism includes two conductive plate springs, and a pressing unit for pressing the plate springs, wherein each of the two plate springs has a first plate spring end in which a contact is provided, and a second plate spring end connected to the substrate in the vicinity of the second terminal end, wherein one of the two plate springs comprises a pressed portion provided in the first spring end, and wherein by operating the window lock button, the pressing unit presses the pressed portion provided in the first plate spring end of the one of the two plate springs or cancels the pressing, so that the contacts provided in the first plate spring ends of the two plate springs are connected or separated.

2. The power window switch according to claim 1, wherein the plate springs are arranged on an opposite side to a side where the window operation knob and the window lock button are placed on the substrate.

3. The power window switch according to claim 1, wherein a plurality of the window operation switch mechanism is provided so as to be spaced from each other in a front and rear direction, and wherein the second terminal end and the second plate spring ends are connected to the substrate between the plurality of window operation switch mechanisms.

4. The power window switch according to claim 3, wherein the plate springs are arranged on an opposite side to a side where the window operation knob and the window lock button are placed on the substrate.

* * * * *